US007249817B2

(12) United States Patent
Vines et al.

(10) Patent No.: US 7,249,817 B2
(45) Date of Patent: Jul. 31, 2007

(54) PRINTER HAVING IMAGE DIVIDING MODES

(75) Inventors: Santiago Garcia-Reyero Vines, San Diego, CA (US); Cesar Fernandez Espasa, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 316 days.

(21) Appl. No.: 11/082,262

(22) Filed: Mar. 17, 2005

(65) Prior Publication Data

US 2006/0209110 A1 Sep. 21, 2006

(51) Int. Cl.
*B41J 2/205* (2006.01)

(52) U.S. Cl. ..... 347/15; 347/16; 347/41; 347/19

(58) Field of Classification Search ..... 347/15, 347/16, 19, 41, 43; 358/1.2, 1.9
See application file for complete search history.

(56) References Cited

U.S. PATENT DOCUMENTS 5,844,583 A * 12/1998 Onishi et al. ..... 347/16
5,844,585 A * 12/1998 Kurashima et al. ..... 347/43
6,002,848 A 12/1999 Takahashi
6,354,690 B1 3/2002 Murakami
6,367,910 B1 4/2002 Sette et al.
2003/0090539 A1 * 5/2003 Lahut et al. ..... 347/43

FOREIGN PATENT DOCUMENTS

| | | |
|---|---|---|
| EP | 0396982 | 11/1990 |
| EP | 1208985 | 5/2002 |
| GB | 1368804 | 10/1974 |

OTHER PUBLICATIONS

International Search Report dated Jul. 4, 2006, for PCT Patent App. No. US2006/007935 (1 page).

* cited by examiner

*Primary Examiner*—Lamson Nguyen

(57) ABSTRACT

A printer includes at least one controller having first mode configured to control printing of an image including a sequence of columns by controlling printing a first column in the sequence and a fourth column in the sequence with a first printhead, a second column in the sequence and a fifth column in the sequence with a second printhead, and a third column in the sequence and a sixth column in the sequence with a third printhead.

27 Claims, 4 Drawing Sheets

PRINTER HAVING IMAGE DIVIDING MODES

BACKGROUND

A conventional inkjet printing system includes a printhead, an ink supply that supplies liquid ink to the printhead, and an electronic controller that controls the printhead. The printhead ejects ink drops through a plurality of orifices or nozzles toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

One type of inkjet printing system is an inline printing system in which one or more printheads are fixed and the print medium is moved relative to the printhead(s). The speed of the print medium relative to the printhead(s) is measured by an encoder. In addition, the encoder tracks the position of the print medium relative to the fixed printheads with a resolution typically indicated in dots per inch (dpi). Typically, for multiple printhead inline printing systems, the image to be printed is divided between two or more printheads by a multiple of the encoder resolution. By dividing the image to be printed into multiple images, the firing frequency of each printhead is reduced. Therefore, the print medium can be moved faster relative to the printheads while having the same final number of drops ejected onto the print medium. For example, in an inline printing system having four printheads and a 150 dots per inch (dpi) encoder, a 600 dpi image to be printed can be divided into four 150 dpi images or two 300 dpi images that are printed interlaced to provide the final desired 600 dpi image.

The printheads have a firing frequency that ranges from zero to a maximum value, such as 36 kHz. In one embodiment, the firing frequency in kHz is defined by the following Equation I:

$$\text{kHz} = \frac{fpm}{5} \times \frac{hRes}{1000} \qquad \text{Equation I}$$

where:

fpm=feet per minute of the print medium relative to the printheads; and hRes=the horizontal resolution of the image.

Typically, in inline printing systems, an encoder is used to measure the speed of the print medium relative to the printhead(s) to set the firing frequency of the printhead(s) needed to obtain the desired resolution. For example, in a 600 dpi printing system having a 150 dpi encoder, one printhead can be used to print at 600 dpi to obtain a final resolution of 600 dpi. The maximum speed of the print medium to print a 600 dpi image using one printhead at a firing frequency of 36 kHz is 300 fpm. The maximum speed of the print medium to print a 600 dpi image using two printheads printing interlaced 300 dpi images at a firing frequency of 36 kHz is 600 fpm. The maximum speed of the print medium to print a 600 dpi image using four printheads printing interlaced 150 dpi images at a firing frequency of 36 kHz is 1200 fpm.

Typically, printheads have a range of values in the middle of the firing frequency range, such as 12 kHz to 24 kHz, where the printheads do not provide a good quality image. The firing frequency interval where the printheads do not provide a good quality image is called the "puddling zone" and should be avoided to obtain good image quality and printhead reliability. Therefore, to avoid the puddling zone, typically certain speeds of the print medium that would require the printheads to fire at a firing frequency within the puddling zone are avoided. In some circumstances, however, it is undesirable to avoid printing at certain speeds, such as where another system controls the print medium speed.

For these and other reasons, there is a need for the present invention.

SUMMARY

One aspect of the present invention provides a printer. The printer includes at least one controller having first mode configured to control printing of an image including a sequence of columns by controlling printing a first column in the sequence and a fourth column in the sequence with a first printhead, a second column in the sequence and a fifth column in the sequence with a second printhead, and a third column in the sequence and a sixth column in the sequence with a third printhead.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
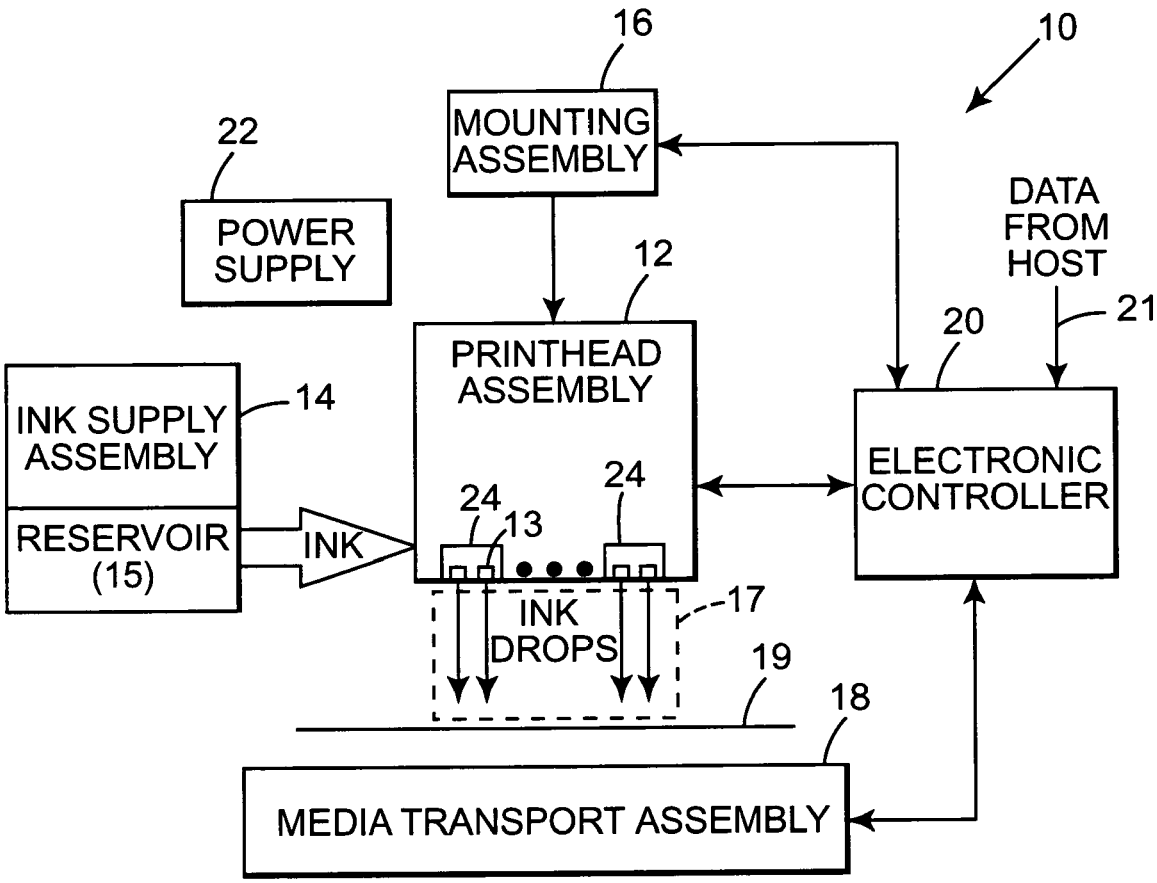
FIG. 1 is a block diagram illustrating one embodiment of an inkjet printing system.

FIG. 1 illustrates one embodiment of an inkjet printing system 10. In one embodiment, inkjet printing system 10 is an inline inkjet printing system configured to print images at any speed up to a maximum speed without using a firing frequency within the puddling zone. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 24 which ejects drops of ink through a plurality of orifices or nozzles 13 toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 includes one or more application-specific integrated circuits (ASICs) for controlling each printhead 24 of inkjet printhead assembly 12. In one embodiment, electronic controller 20 controls inkjet printhead assembly 12 for ejection of ink drops from nozzles 13. As such, electronic controller 20 defines a pattern of ejected ink drops that form characters, symbols, and/or other graphics or images on print medium 19. The pattern of ejected ink drops is determined by the print job commands and/or command parameters.

In one embodiment, inkjet printhead assembly 12 includes one printhead 24. In another embodiment, inkjet printhead assembly 12 is a wide-array or multi-head printhead assembly. In one wide-array embodiment, inkjet printhead assembly 12 includes a carrier, which carries printheads 24, provides electrical communication between printheads 24 and electronic controller 20, and provides fluidic communication between printheads 24 and ink supply assembly 14. In one embodiment, each printhead 24 has its own ink supply assembly 14, which are housed together in an inkjet cartridge or pen.

Figure 2:
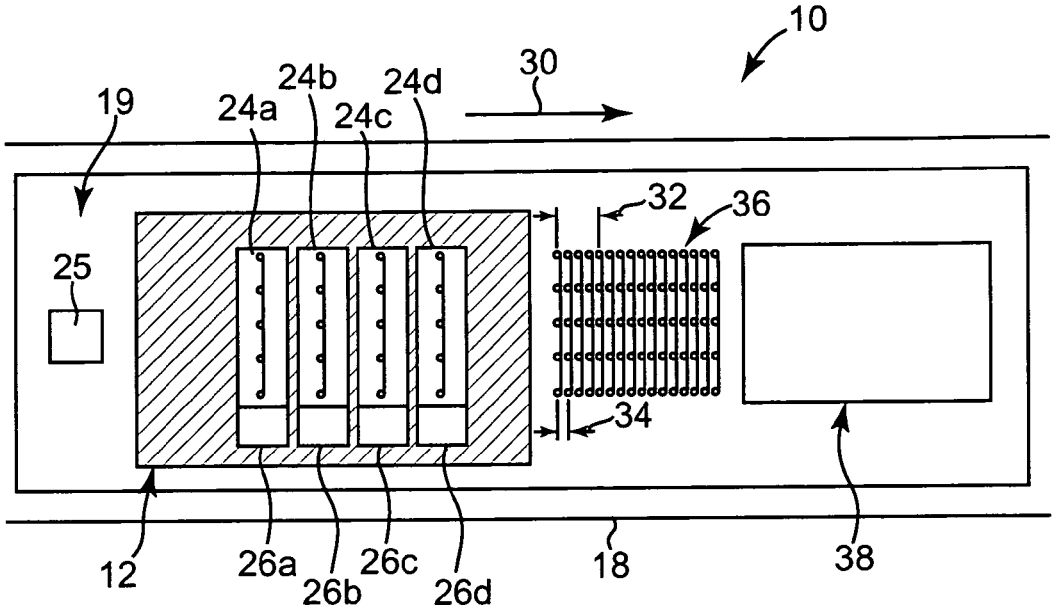
FIG. 2 is a diagram illustrating one embodiment of an inline printing system.

FIG. 2 is a diagram illustrating one embodiment of inline printing system 10. In this embodiment, printhead assembly 12 includes four printheads 24*a*-24*d*, which are fixed with respect to media transport assembly 18. In one embodiment, printing system 10 includes four ASICs 26*a*-26*d* for controlling corresponding printheads 24*a*-24*d*. In one embodiment, each printhead 24*a*-24*d* has its own ink supply assembly 14, with each printhead and ink supply assembly housed together in an inkjet cartridge or pen. Print medium 19 is moved relative to printhead assembly 12 in the direction indicated by arrow 30 to print image 36. Electronic controller 20 divides data 21 to be printed between printheads 24*a*-24*d* such that printheads 24*a*-24*d* print interlaced images to obtain the final desired image. In one embodiment, the movement of print medium 19 is measured by an encoder 25. In one form of the invention, encoder 25 is a 150 dots per inch (dpi) encoder.

In one embodiment, 600 dpi image data is printed on print medium 19 by dividing the image data into four 150 dpi images, each of which is printed by a separate printhead 24*a*-24*d*. Therefore, the 600 dpi image data, one column of which is indicated at 32 as 1/600 of an inch, is divided into four 150 dpi images, one column of which is indicated at 32 as 1/150 of an inch, which when interlaced provide the printed overlap area as indicated at 38. In another embodiment, 600 dpi image data is printed on print medium 19 by dividing the image data into three 200 dpi images, each of which is printed by a separate printhead. In yet another embodiment, 600 dpi image data is printed on print medium 19 by dividing the image data into two 300 dpi images, each of which is printed by a separate printhead.

Figure 3:
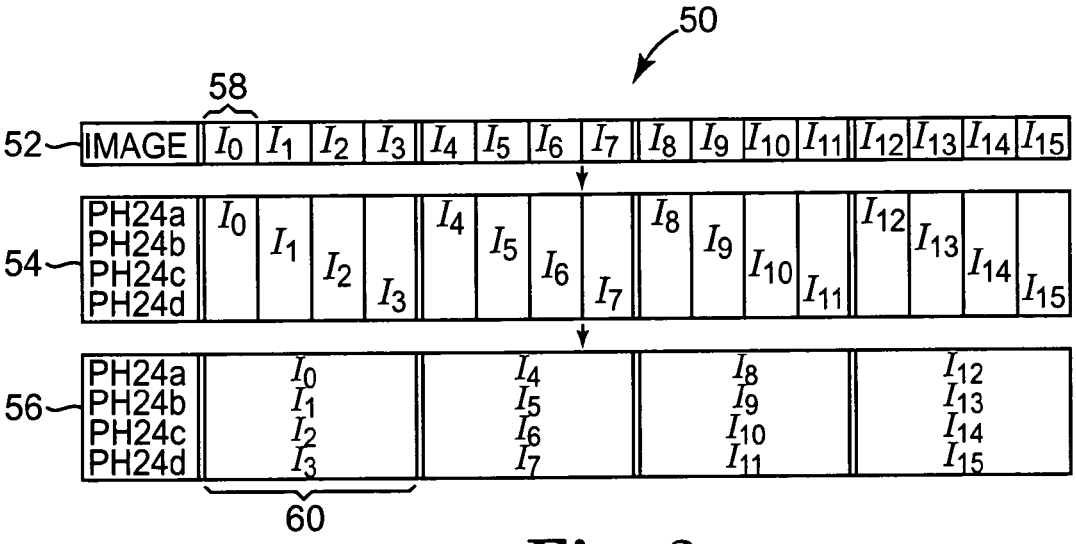
FIG. 3 is a table illustrating one embodiment of processing print data for printing on a printing system.

FIG. 3 is a table 50 illustrating one embodiment of processing print data for printing on printing system 10. In this embodiment, the image data to be printed is divided into four images to be printed interlaced by four printheads to obtain the desired image. The image data is divided by a multiple of the encoder resolution. In one embodiment, electronic controller 20 receives image data 52. In one embodiment, image data 52 is 600 dpi image data, such that each 'I' 58 is 1/600 of an inch. Image data 52 is divided into columns $I_0$-$I_{15}$, where each column $I_0$-$I_{15}$ is passed to a different printhead, as indicated at 54. In one embodiment, each indicated column $I_0$-$I_{15}$ is passed to the ASIC 26*a*-26*d* associated with each corresponding printhead 24*a*-24*d*. As indicated at 54, printhead 24*a* receives the $I_0$ column data, printhead 24*b* receives the $I_1$ column data, printhead 24*c* receives the $I_2$ column data, and printhead 24*d* receives the $I_3$ column data. The division of image data 52 continues with printhead 24*a* receiving the $I_4$ column data, etc.

Therefore, as indicated at 56, printhead 24*a* receives the $I_0$, $I_4$, $I_8$, and $I_{12}$ column data. Printhead 24*b* receives the $I_1$, $I_5$, $I_9$, and $I_{13}$ column data. Printhead 24*c* receives the $I_2$, $I_6$, $I_{10}$, and $I_{14}$ column data, and printhead 24*d* receives the $I_3$, $I_7$, $I_{11}$, and $I_{15}$ column data. In this embodiment, printhead 24*a* prints every 1/150 of an inch as indicated at 60 to print the $I_0$, $I_4$, $I_8$, and $I_{12}$ column data to produce a 150 dpi image. Likewise, printhead 24*b* prints the $I_1$, $I_5$, $I_9$, and $I_{13}$ column data to produce a 150 dpi image, printhead 24*c* prints the $I_2$, $I_6$, $I_{10}$, and $I_{14}$ column data to produce a 150 dpi image, and printhead 24*d* prints the $I_3$, $I_7$, $I_{11}$, and $I_{15}$ column data to produce a 150 dpi image. The four 150 dpi images of printhead 24*a* through printhead 24*d* are printed interlaced on print medium 19 to provide the desired 600 dpi image of image data 52.

In another embodiment, two printheads are used to print image data 52. Once again, the image data is divided by a multiple of the encoder resolution. In this embodiment, one of the printheads receives the even numbered columns and the other of the printheads receives the odd numbered columns. The even numbered column data produces a 300 dpi image and the odd numbered column data also produces a 300 dpi image. The two 300 dpi images of the two printheads are printed interlaced on print medium 19 to provide the desired 600 dpi image of image data 52. These embodiments have a disadvantage in that they cannot operate at all speeds up to a maximum speed without printing in the puddling zone since each printhead 24*a* through 24*d* prints at a resolution that is a multiple of the encoder resolution of 150 dpi. Therefore using this process, a 600 dpi image cannot be divided by a multiple of the 150 dpi resolution of the encoder to print using three printheads.

Figure 4:
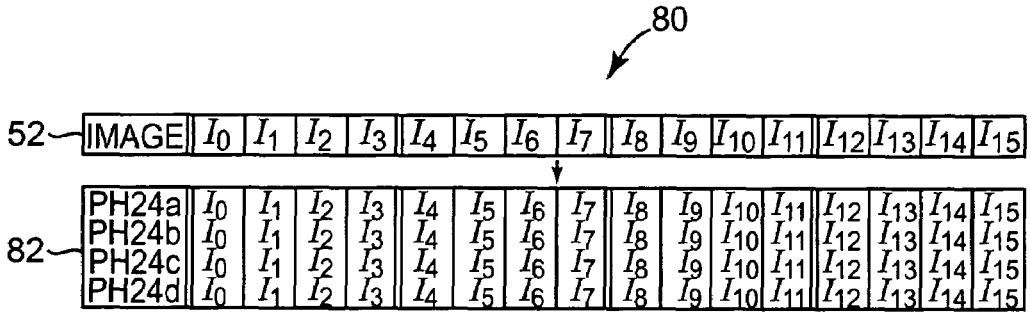
FIG. 4 is a table illustrating another embodiment of processing print data for printing on a printing system.

FIG. 4 is a table 80 illustrating another embodiment of processing print data for printing on printing system 10. In this embodiment, printing system 10 can print at any speed up to the maximum speed without printing in the puddling zone. In this embodiment, image data 52 is received in electronic controller 20, however, each ASIC 26*a*-26*d* associated with each printhead 24*a*-24*d* receives all the column data and not just the column data to be printed by the associated printhead. ASIC 26*a* receives the $I_0$-$I_{15}$ column data, ASIC 26*b* receives the $I_0$-$I_{15}$ column data, ASIC 26*c* receives the $I_0$-$I_{15}$ column data, and ASIC 26*d* receives the $I_0$-$I_{15}$ column data. Therefore, each ASIC/printhead combination is capable of printing any column of data and not just the data provided to the printhead by the process illustrated in FIG. 3.

Figure 5:
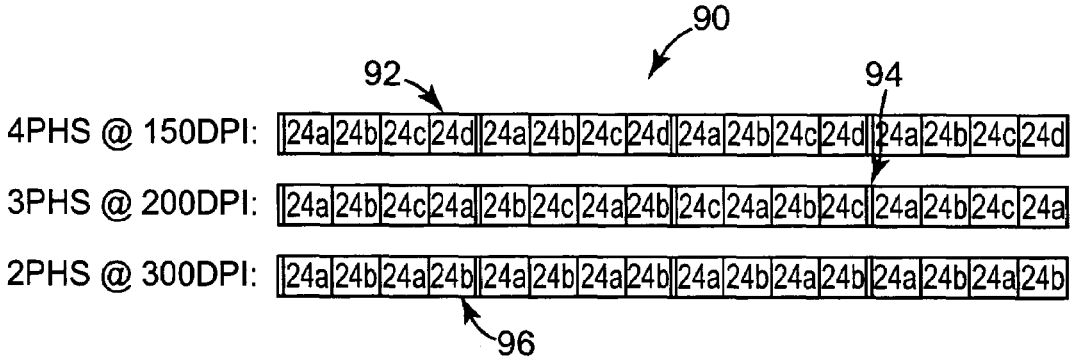
FIG. 5 is a table illustrating one embodiment of modes for printing on a printing system.

FIG. 5 is a table 90 illustrating one embodiment of modes for printing on printing system 10 using the column data passed to ASICs 26*a*-26*d* as illustrated in table 80 of FIG. 4 or using the column data in electronic controller 20. Table 90 illustrates which printheads print the column data $I_0$-$I_{15}$ based on the mode selected. The columns of table 90 correspond to the column data $I_0$-$I_{15}$. The column data $I_0$-$I_{15}$ is printed by the corresponding printhead 24*a* through printhead 24*d* indicated by the printhead numbers in each column of table 90. In one embodiment, the printhead numbers for each mode are stored in arrays within electronic controller 20 or within the ASIC 26*a*-26*d* associated with each printhead.

In this embodiment, the image data to be printed is 600 dpi. A first mode uses four printheads printing at 150 dpi. In this mode, the indicated printheads 24*a* through 24*d* print the column data as indicated in row 92. In this mode, printhead 24*a* prints the $I_0$ column data, printhead 24*b* prints the $I_1$ column data, printhead 24*c* prints the $I_2$ column data, and printhead 24*d* prints the $I_3$ column data. This mode is similar to table 50 illustrated in FIG. 3. The process repeats with the $I_4$-$I_7$ column data printed by printheads 24*a* through 24*d*, respectively.

A second mode uses three printheads printing at 200 dpi. In this mode, the indicated printheads 24*a* through 24*c* print the column data as indicated in row 94. In this mode, printhead 24*a* prints the $I_0$ column data, printhead 24*b* prints the $I_1$ column data, and printhead 24*c* prints the $I_2$ column data. The process repeats with the $I_3$-$I_5$ column data printed by printheads 24*a* through 24*c*, respectively. This second mode is not possible using the process of FIG. 3, since 200 dpi is not a multiple of the 150 dpi encoder.

A third mode uses two printheads printing at 300 dpi. In this mode, the indicated printheads 24*a* and 24*b* print the column data as indicated in row 96. In this mode, printhead 24*a* prints the even numbered column data $I_0$, $I_2$, $I_4$ etc., and printhead 24*b* prints the odd numbered column data $I_1$, $I_3$, $I_5$, etc.

Figure 6:
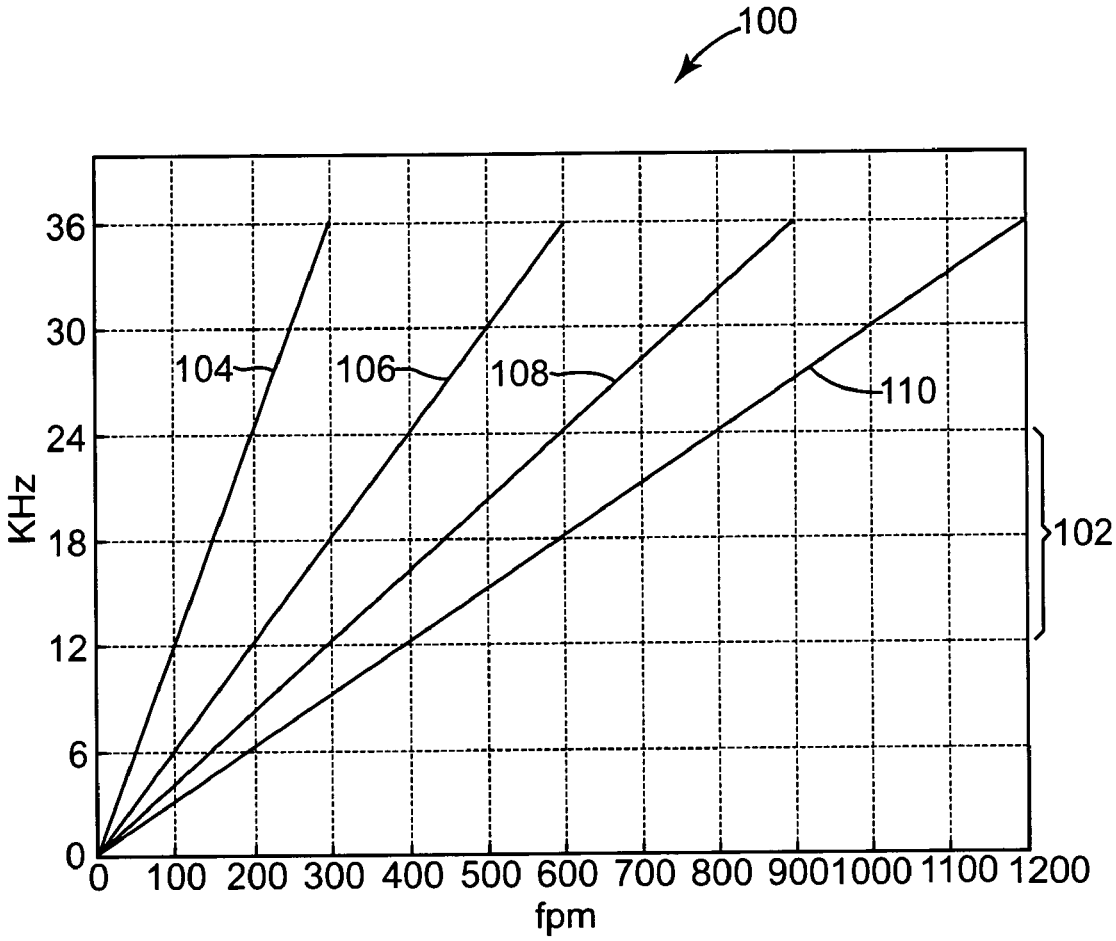
FIG. 6 is a graph illustrating one embodiment of selecting a mode to avoid the puddling zone when printing on a printing system while printing at any speed up to a maximum speed.

FIG. 6 is a graph 100 illustrating one embodiment of selecting a mode to avoid the puddling zone when printing on printing system 10 while printing at any speed up to the maximum speed. The puddling zone is indicated at 102 and in this embodiment includes a firing frequency within the range of 12 kHz to 24 kHz. The printhead firing frequency (kHz) versus print medium speed (fpm) for printing with one printhead is indicated by line 104, with two printheads is indicated by line 106, with three printheads is indicated by line 108, and with four printheads is indicated by line 110.

In one embodiment, the puddling zone is avoided between speeds 0 and 400 fpm by using four printheads with each printhead printing at 150 dpi to obtain a 600 dpi image as indicated by line 110. The puddling zone is avoided between speeds 400 and 600 fpm by using two printheads with each printhead printing at 300 dpi to obtain a 600 dpi image as indicated by line 106. The puddling zone is avoided between speeds 600 and 900 fpm by using three printheads with each printhead printing at 200 dpi to obtain a 600 dpi image as indicated by line 108. The puddling zone is avoided between 900 and 1200 fpm by using four printheads with each printhead printing at 150 dpi to obtain a 600 dpi image as indicated by line 110.

Using this method, printer 10 can print 600 dpi images with three inline printheads firing at 200 dpi while using a 150 dpi encoder. At 600 fpm, the firing frequency is 24 kH and at 800 fpm, the firing frequency is 32 kH, avoiding the puddling zone. Therefore, putting the possible resolutions together as described with reference to FIG. 6, in one embodiment, printer 10 can print up to 1200 fpm with a resolution of 600 dpi without printing in the puddling zone and by using the same 150 dpi encoder.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printer comprising:

at least one controller having a first mode configured to control printing of an image comprising a sequence of columns by controlling printing a first column in the sequence and a fourth column in the sequence with a first printhead, a second column in the sequence and a fifth column in the sequence with a second printhead, and a third column in the sequence and a sixth column in the sequence with a third printhead.

2. The printer of claim 1, comprising:

the at least one controller having a second mode configured to control printing the image comprising the sequence of columns by controlling printing odd columns in the sequence with the first printhead and even columns in the sequence with the second printhead; and the at least one controller having a third mode configured to control printing the image comprising columns by controlling printing the first column and the fifth column with the first printhead, the second column and the sixth column with the second printhead, the third column and a seventh column in the sequence with the third printhead, and the fourth column and an eighth column in the sequence with a fourth printhead.

3. The printer of claim 2, wherein the image comprises a 600 dots per inch image and in the second mode the first printhead and the second printhead are both configured to print 300 dots per inch images comprising one half of the 600 dots per inch image.

4. The printer of claim 2, wherein the image comprises a 600 dots per inch image and in the third mode the first printhead, the second printhead, the third printhead, and the fourth printhead are each configured to print 150 dots per inch images comprising one fourth of the 600 dots per inch image.

5. The printer of claim 2, wherein the at least one controller is configured to select one of the first mode, the second mode, and the third mode based on a speed of a print medium relative to the first printhead, the second printhead, the third printhead, and the fourth printhead.

6. The printer of claim 5, wherein the at least one controller is configured to select one of the first mode, the second mode, and the third mode based on avoiding a puddling zone of the first printhead, the second printhead, the third printhead, and the fourth printhead.

7. The printer of claim 1, wherein the at least one controller comprises application-specific integrated circuits associated with the first printhead, the second printhead, and the third printhead.

8. The printer of claim 1, wherein the image comprises a 600 dots per inch image and the first printhead, the second printhead, and the third printhead are each configured to print 200 dots per inch images comprising one third of the 600 dots per inch image.

9. A printer comprising:

a printhead assembly comprising N printheads;

an encoder configured to measure the speed of a print medium relative to the printhead assembly; and at least one controller configured to control the N printheads based on the speed of the print medium to print an image using four printheads for a first speed range and a second speed range, print the image using two printheads for a third speed range, and print the image using three printheads for a fourth speed range to avoid printing the image in a puddling zone, wherein the first speed range is slower than the third speed range, the third speed range is slower than the fourth speed range, and the fourth speed range is slower than the second speed range.

10. The printer of claim 9, wherein N equals four.

11. The printer of claim 9, wherein the first speed range comprises approximately 0-400 fpm, the second speed range comprises approximately 900-1200 fpm, the third speed range comprises approximately 400-600 fpm, and the fourth speed range comprises approximately 600-900 fpm.

12. A printer comprising:

a printhead assembly comprising four printheads; and an electronic controller configured to:

receive an image comprising columns of data;

selectively send the columns of data to the four printheads;

receive a speed of a print medium with respect to the four printheads; and based on the speed of the print medium and to avoid a puddling zone of the four printheads, select one of the following:

print even columns of data with a first printhead and odd columns of data with a second printhead;

print a first column and a fourth column of data with the first printhead, a second column and a fifth column of data with the second printhead, and a third column and a sixth column of data with a third printhead; and print the first column and the fifth column of data with the first printhead, the second column and the sixth column of data with the second printhead, the third column and a seventh column of data with the third printhead, and the fourth column and an eighth column of data with a fourth printhead.

13. An printing system comprising:

N fixed printheads;

an encoder having a first resolution, the encoder configured to provide an output indicating a speed of print media past the N fixed printheads; and a controller configured to receive image data having a second resolution and control at least three printheads each printing at a third resolution and interlaced to print the image at the second resolution, wherein the third resolution is not a multiple of the first resolution.

14. The printing system of claim 13, wherein the controller is configured to one of control a single printhead printing at the second resolution to print the image at the second resolution, control two printheads each printing at one half the second resolution and interlaced to print the image at the second resolution, and control four printheads each printing at the first resolution and interlaced to print the image at the second resolution.

15. The printing system of claim 14, wherein the controller is configured to control one of the single, two, three, and four printheads based on the speed of the print media to avoid printing in a puddling zone.

16. The printing system of claim 15, wherein the puddling zone is within the approximate range of 12 kHz to 24 kHz.

17. The printing system of claim 15, wherein the speed of the print media is within the approximate range of 0 fpm to 1200 fpm.

18. The printing system of claim 13, wherein N equals four.

19. The printing system of claim 13, wherein the first resolution equals 150 dots per inch.

20. The printing system of claim 19, wherein the third resolution equals 200 dots per inch.

21. The printing system of claim 20, wherein the second resolution equals 600 dots per inch.

22. A printer comprising:

means for determining a speed of a print medium relative to a printhead assembly comprising N printheads, wherein N is at least four;

means for receiving an image having a first resolution; and means for dividing the image into two to N images at a second resolution for printing using two to N of the printheads, respectively, wherein the images are printed interlaced to provide the image at the first resolution and wherein the dividing is based on the speed of the print medium and to avoid printing in a puddling zone of the printheads.

23. A method for printing an image on a printer, the method comprising:

receiving an image comprising columns of data;

receiving a speed of a print medium with respect to the N printheads; and based on the speed of the print medium and to avoid a puddling zone of the N printheads selecting one of the following for printing the image:

printing even columns of data with a first printhead and odd columns of data with a second printhead;

printing a first column and a fourth column of data with the first printhead, a second column and a fifth column of data with the second printhead, and a third column and a sixth column of data with a third printhead; and printing the first column and the fifth column of data with the first printhead, the second column and the sixth column of data with the second printhead, the third column and a seventh column of data with the third printhead, and the fourth column and an eighth column of data with a fourth printhead.

24. The method of claim 23, wherein receiving an image comprises receiving a 600 dots per inch image, and wherein printing even columns of data with the first printhead and odd columns of data with the second printhead comprises printing a first 300 dots per inch image comprising a first half of the 600 dots per inch image with the first printhead and printing a second 300 dots per inch image comprising a second half of the 600 dots per inch image with the second printhead.

25. The method of claim 23, wherein receiving an image comprises receiving a 600 dots per inch image, and wherein printing the first column and the fifth column of data with the first printhead, the second column and the sixth column of data with the second printhead, the third column and the seventh column of data with the third printhead, and the fourth column and the eighth column of data with the fourth printhead comprises printing a first 150 dots per inch image comprising a first fourth of the 600 dots per inch image with the first printhead, printing a second 150 dots per inch image comprising a second fourth of the 600 dots per inch image with the second printhead, printing a third 150 dots per inch image comprising a third fourth of the 600 dots per inch image with the third printhead, and printing a fourth 150 dots per inch image comprising a fourth fourth of the 600 dots per inch image with the fourth printhead.

26. The method of claim 23, wherein receiving an image comprises receiving a 600 dots per inch image, and wherein printing the first column and the fourth column of data with the first printhead, the second column and the fifth column of data with the second printhead, and the third column and the sixth column of data with the third printhead comprises printing a first 200 dots per inch image comprising a first third of the 600 dots per inch image with the first printhead, printing a second 200 dots per inch image comprising a second third of the 600 dots per inch image with the second printhead, and printing a third 200 dots per inch image comprising a third of the 600 dots per inch image with the third printhead.

27. A method for printing an image on a printer, the method comprising:

receiving a 600 dots per inch image comprising 600 columns of data per inch;

receiving a speed of a print medium with respect to four printheads from a 150 dots per inch encoder;

based on the speed of the print medium and to avoid a puddling zone of the four printheads, selecting one of a first mode, a second mode, and a third mode for printing the 600 dots per inch image;

wherein the first mode comprises printing even columns with a first printhead and odd columns with a second printhead;

wherein the second mode comprises printing a first column and a fourth column with the first printhead, a second column and a fifth column with the second printhead, and a third column and a sixth column with a third printhead; and wherein the third mode comprises printing the first column and the fifth column with the first printhead, the second column and the sixth column with the second printhead, the third column and a seventh column with the third printhead, and the fourth column and an eighth column with a fourth printhead.

* * * * *

UNITED STATES PATENT AND TRADEMARK OFFICE

CERTIFICATE OF CORRECTION

PATENT NO. : 7,249,817 B2
APPLICATION NO. : 11/082262
DATED : July 31, 2007
INVENTOR(S) : Santiago Garcia-Reyero Vines et al.

It is certified that error appears in the above-identified patent and that said Letters Patent is hereby corrected as shown below:

In column 4, line 46, delete "32" and insert -- 34 --, therefor.

In column 10, line 23, in Claim 26, after "a third" insert -- third --.

Signed and Sealed this

Nineteenth Day of August, 2008

JON W. DUDAS
*Director of the United States Patent and Trademark Office*